United States Patent [19]

Guido et al.

[11] 4,043,506

[45] Aug. 23, 1977

[54] INJECTION LINE SYSTEM

[76] Inventors: Jurgen Guido, Borsigstrasse 4; Robert Stock, Dresdener Strasse 1, both of 8402 Neutraubling, Germany

[21] Appl. No.: 700,471

[22] Filed: June 28, 1976

[51] Int. Cl.[2] ..... B05B 15/00

[52] U.S. Cl. ..... 239/76; 123/139 AT

[58] Field of Search ..... 239/76; 123/32 R, 139 R, 123/139 AW, 136, 139 AA, 139 AT

[56] References Cited

U.S. PATENT DOCUMENTS 2,816,745 12/1957 McCain ..... 123/139 AW

*Primary Examiner*—Evon C. Blunk
*Assistant Examiner*—Michael Mar

[57] ABSTRACT

An injection line system wherein the injection lines for linking an injection pump with associated injection nozzles are coupled together in a predetermined manner to damp operational vibrations. At least one of the lines is provided with a bend so that a section of this line ahead of the bend and leading to its associated nozzle extends in a direction so as to oppose the flow path in a section of at least another one of the lines, the two sections being coupled together by means which damp operational vibrations.

2 Claims, 2 Drawing Figures

INJECTION LINE SYSTEM

BACKGROUND OF THE INVENTION

This invention relates to an injection line system comprising several injection lines of the same cross-section and length freely laid between respective connection points of an injection pump and variously distributed injection nozzles, and which for the purpose of suppressing operational vibrational movements are bundled together with the formation where appropriate of compensation bends in the injection lines leading to the less distantly disposed injection nozzles. The lines are also linked together in the region of neighbouring injection nozzles by vibration damping rings and pipe clips, whereby two or more injection lines in the region of the associated injection nozzles are run side-by-side in a direction parallel to the line joining the connection points of these injection nozzles, and pipe clips together with vibration-damping rubber rings linking these lines together are provided along this direction.

The injection lines situated between an injection pump normally disposed at the crank chamber of an associated internal combustion engine and the injection nozzles located at the individual working cylinders of this engine, experience operational vibrational stresses which are generated on the one hand by the considerable injection pressures of the pulsating fuel along the lines and on the other hand by the more or less large vibrations of the internal combustion engine itself, which are experienced because of unbalanced inertia forces and, in the case of power-propelled vehicles, because of track unevenness and other external force influences. Where these vibration stresses are not absorbed by suitably clamping the lines together and/or to the internal combustion engine, the injection lines suffer slight vibration fatigue fractures, especially in the region of the fixing positions at its two ends, i.e. at the injection pump at one end and at the injection nozzles at the other end. Since it is complicated and costly to fix the injection lines to the internal combustion engine which requires considerably different re-routing of the injection lines, and also increasing the time requirement for dismantling and reassembly of the internal combustion engine, there is a limitation in practice mostly to the initially described linking together of the freely laid injection lines by vibration-damping rubber rings and pipe clips. This also simplifies the assembly and dismantling of the injection lines in so far as it makes it possible to gather all injection lines of the internal combustion engine into one or, if need be, two or three bundles so that their assembly becomes rapid and easy.

While it is comparatively easy to gather together several injection lines in the region of the injection pump, the connection points for the injection lines of which notably lie close to each other, the injection nozzles located at the individual working cylinders of the internal combustion engine are generally at such a large distance apart that a common fixing for several injection lines in the direct neighbourhood of the injection nozzles has only up to now been sporadically obtained. In a known diesel engine illustrated on page 317 of the MTZ Motortechnische Zeitung 25/8 in FIG. 34, the injection line system is laid in the initially described manner, whereby two or three injection lines extending parallel to each other in the same flow direction are linked together by pipe clips in the region of the neighbouring injection nozzles. While a certain vibration damping is attainable by such a linkage together of injection lines, vibration fractures cannot thereby as yet be reliably prevented.

SUMMARY OF THE INVENTION

An object of the invention is to so improve the fixing together of the injection lines of the initially described injection line system so that the danger of vibration fatigue fractures in the injection lines is as far as possible completely excluded.

This object is attained according to the invention, in that two injection lines are led to the associated injection nozzles by way of appropriate bends in opposite directions and with opposing flows in mutual overlap, a pipe clip together with vibration-damping rubber rings linking the lines together being disposed in this overlap position.

It has been shown that such a fixing together of two injection lines with opposing flows produces a considerable further reduction in vibrational stress, explained by the fact that the operational vibrations generated in the longitudinal direction along the lines by the pulsating fuel feed are to a large extent mullified. It was in fact shown through tests that absolutely no further vibration fatigue fractures were to be found in such injection lines linked together parallel to each other in a position of opposing flow.

BRIEF DESCRIPTION OF THE DRAWINGS

The invention will now be described by way of example with reference to the accompanying drawings, in which.

DETAILED DESCRIPTION OF PREFERRED EMBODIMENTS

Figure 1:
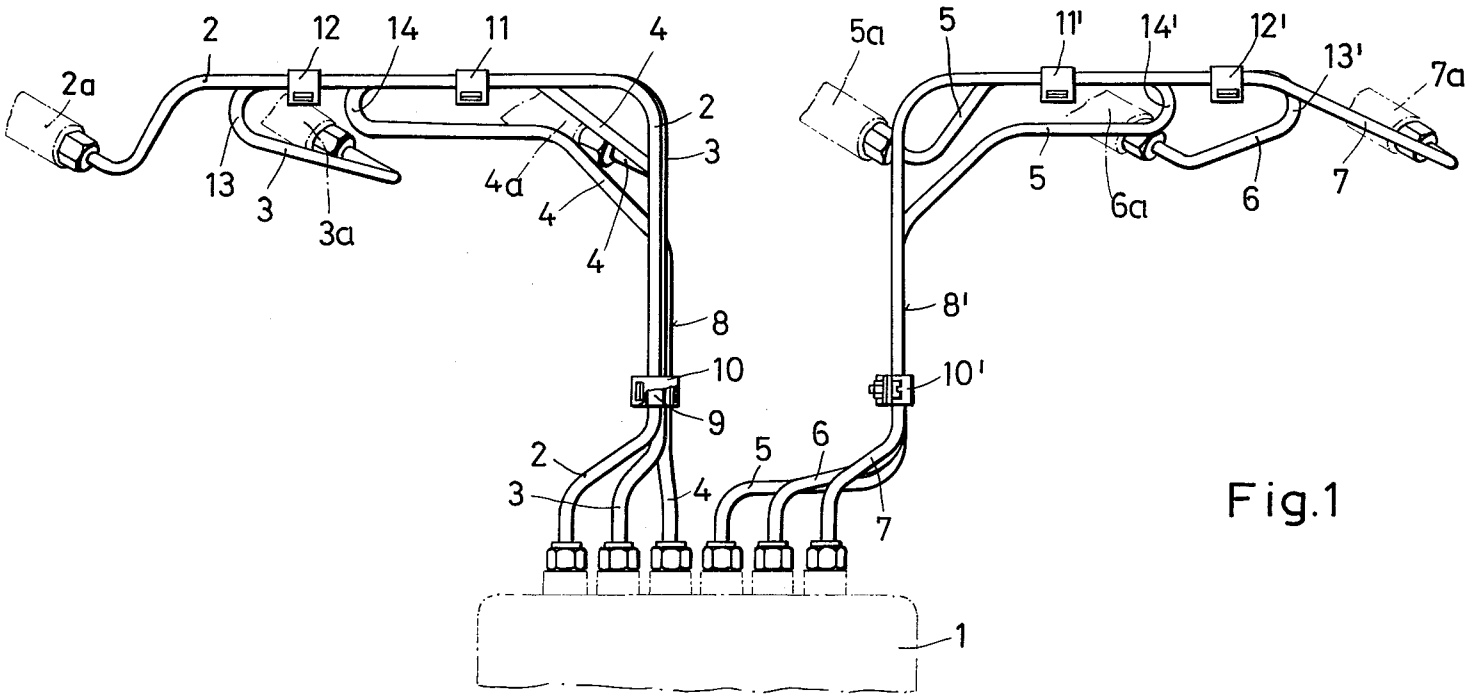
FIG. 1 is a side view of an injection line system for an internal combustion engine in the form of a six-cylinder in-line engine.
Figure 2:
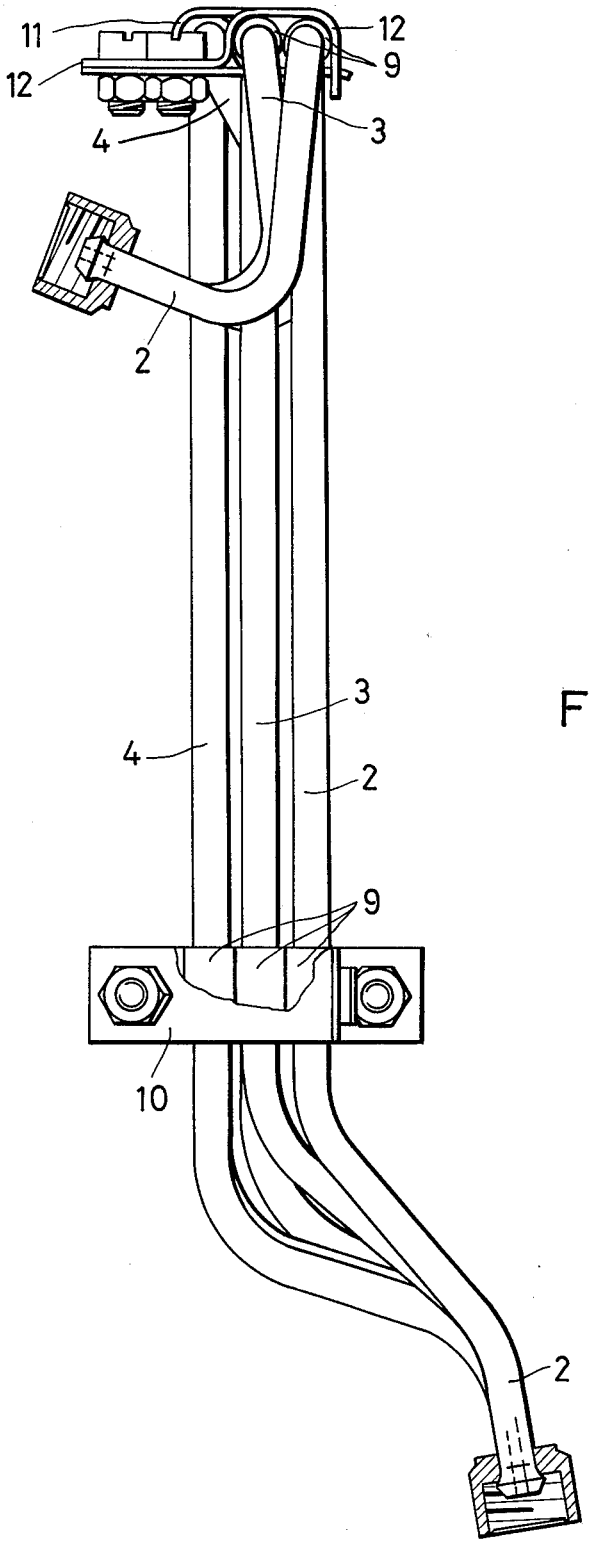
FIG. 2 is an end view of the line system seen from the left in FIG. 1.

With reference to the drawings, six injection lines 2, 3, 4, 5, 6 and 7 each run from a diagrammatically indicated injection pump 1 of an internal combustion engine (not shown) in the form of a six-cylinder in-line motor, to a diagrammatically associated injection nozzle *2a, 3a, 4a, 5a, 6a* and *7a*. As can be seen from FIG. 1, the first three injection lines 2, 3 and 4 and the remaining three injection lines 5, 6 and 7 are bundled together at respective short distances from the injection pump 1 which is positioned at the internal combustion engine in the region of the crank chamber in a manner not shown, into bundles 8 and 8' extending to the cylinder heads in a direction parallel to the working cylinder axes. Each bundle is held together initially by single vibration damping rubber rings 9 which surround the individual injection lines 2, 3, 4 and 5, 6, 7 as shown in FIG. 2, and pipe clips 10 and 10' which grip thereon. The two injection lines 2 and 3 run side-by-side from the bundle 8 until they pass an imaginary line joining the connection points of the injection nozzles *2a, 3a* and *4a*, and then extend together side-by-side over this joining line (see FIG. 1) after bending in a direction parallel to the imaginary joining line. They extend in this direction to the injection nozzle *3a* and are then linked together between the injection nozzles *3a* and *2a* by a further respective pipe clip 11 and 12 together with rubber rings (not shown). Whereas the injection line 2 is then led to the injection nozzle *2a* by way of a suitable bend, the injection line 3 is led to the injection nozzle 3*a* by way of a reverse bend 13 after the pipe clip 12.

The injection line 4 leaves the bundle 8 below the said imaginary joining line by way of a leftward directed bend (relative to FIG. 1) and extends beyond the associated injection nozzle 4*a* as far as the injection nozzle 3*a*, where it curves backwards by way of an upward 180° bend 14 to reach the aforesaid direction of the injection lines 2 and 3. It then extends directly to the injection lines 2 and 3, as shown in FIG. 2, and is held together therewith by the pipe clip 11. The injection line 4 then finally extends through a corresponding bend to the injection nozzle 4*a*.

By means of the previously depicted layout of the injection lines 2, 3 and 4, these lines may also be held together in a vibration damping manner by the pipe clips 11 and 12 in the region of their associated injection nozzles 2*a*, 3*a* and 4*a*, and this correspondingly reduces the vibration stress in the lines in the direct region of the injection nozzles 2*a*, 3*a* and 4*a*. The described line layout for the injection line 4 is possible because in order to obtain the same injection conditions all injection lines of the internal combustion engine have not only the same flow cross-section but also exactly the same length, and the injection line 4 which has to cross the shortest distance has a correspondingly excessive line length which is able to be used in the described manner for reversing the direction in bringing it to the other two injection lines 2 and 3. This further bundling of the injection lines 2, 3 and 4 at the pipe clip 11 gives the further advantage that the injection line 4 has a flow direction thereat which is opposite to that of the injection lines 2 and 3. It has been found that the pulsating flow corresponding to the injection cycle for the internal combustion engine in the injection line 4 which is in a direction opposite the flow direction through the injection lines 2 and 3 in the region of the pipe clip 11, has a damping effect on the line vibrations generated by the pulsating flow through the injection lines 2 and 3. Overall there is thus an extremely effective damping of all operationally occurring line vibrations, obtained not only by the pipe clip 10 in the region of the injection pump 1, but also by the other two pipe clips 11 and 12 in the region of the injection nozzles 2*a*, 3*a* and 4*a*.

The injection lines 6 and 7 extend upwards from the bundle 8′ and over the line joining the connection points of the injection nozzles 5*a*, 6*a* and 7*a*, and (with reference to FIG. 1) then bent rightwards in a direction parallel to this joining line. There they are linked together by a pipe clip 11′ (together with rubber rings, not shown) between the injection nozzles 5*a* and 6*a*, and by a further pipe clip 12′ between the injection nozzles 6*a* and 7*a*, these two pipe clips 11′ and 12′ corresponding in their arrangement approximately to the pipe clips 11 and 12 of the bundle 8. The injection line 7 extends to the injection nozzle 7*a* furthest to the right (in FIG. 1) while the injection line 6 extends backwards after the pipe clip 12′ by way of a bend 13′ corresponding to the bend 13 of the injection line 3. The injection line 5 extends the bundle 8′ below the said joining line (with reference to FIG. 1) in a rightward direction and is bent backwards in the region of the injection nozzle 6*a* by way of a semi-circular bend 14′ corresponding to the bend 14 in the direction of the injection lines 6 and 7 at that position. It then extends backwards towards the left directly to the side of the latter two lines (with reference to FIG. 1) and is again held together with these two lines by the pipe clip 11′. It then runs to the injection nozzle 5*a* after the pipe clip 11′ by way of an appropriate bend.

From a comparison of the layouts of the injection lines 2, 3 and 4 on the one hand and the injection lines 5, 6 and 7 on the other hand, it can be seen that the injection lines 5, 6 and 7 have basically the same advantageous fixing as the injection lines 2, 3 and 4, and thus any repetition of the effect obtained on the injection lines 5, 6 and 7 would be superfluous.

Although the described and illustrated embodiment relates to the laying of injection lines to a six cylinder in-line engine, it is evident from this example that similarly advantageous line laying arrangements are possible for other internal combustion engines with injection, such as with four, eight or more working cylinders.

I claim:

1. An injection line system for linking an injection pump with a series of associated injection nozzles and comprising a plurality of injection lines of the same cross-section and length for mounting to extend between respective connection points of said injection pump and said injection nozzles, means for bundling said injection lines together at predetermined points to suppress operational vibration movements in said lines with the formation of compensation bends in the injection lines leading to said injection nozzles, coupling means for retaining portions of two or more of said injection lines in the region of their associated injection nozzles in side-by-side relationship and in a first flow direction parallel to an imaginary line joining the connection points of said associated injection nozzles, at least another one of said injection lines being provided with a bent portion to define a section thereof extending in a second flow direction to its associated nozzle and opposite to said first flow direction, said section being in mutual overlap with respect to said injection lines disposed in side-by-side relationship and being coupled thereto by said coupling means.

2. An injection line system as claimed in claim 1, wherein said coupling means includes a pipe clip and associated damping pad for damping operational vibrations, said coupling means retaining a further injection line extending parallel to said lines disposed in side-by-side relationship and in said first flow direction.

* * * * *